US005815993A

United States Patent [19]

Castola et al.

[11] Patent Number: 5,815,993

[45] Date of Patent: Oct. 6, 1998

[54] DEVICE FOR ANCHORING THE FOUNDATION OF A STRUCTURE IN THE GROUND

[75] Inventors: Charles-Alain Castola, Hyeres; Charles Pasqualini, Feurs; René Laugeois, Saint Hilaire de Brethmas, all of France

[73] Assignee: Tecnivalor (S.A.R.L.), Hyeres les Palmiers, France

[21] Appl. No.: 809,887

[22] PCT Filed: Oct. 9, 1995

[86] PCT No.: PCT/FR95/01316

§ 371 Date: Apr. 4, 1997

§ 102(e) Date: Apr. 4, 1997

[87] PCT Pub. No.: WO96/12068

PCT Pub. Date: Apr. 25, 1996

[30] Foreign Application Priority Data

Oct. 14, 1994 [FR] France ..... 94 12563

[51] Int. Cl.[6] ..... E02D 5/80

[52] U.S. Cl. ..... 52/166; 52/163

[58] Field of Search ..... 52/166, 163, 162

[56] References Cited

U.S. PATENT DOCUMENTS 2,841,256 7/1958 Clevett, Jr. .

3,139,163 6/1964 Haller .

4,611,446 9/1986 Beavers .

FOREIGN PATENT DOCUMENTS 2678010 12/1992 France .

8503319 8/1985 WIPO .

*Primary Examiner*—Robert Canfield

*Attorney, Agent, or Firm*—Ladas & Parry

[57] ABSTRACT

Device for anchoring the foundation of a structure in the ground comprising an anchor (1) and a pull line (8) along an axis (ZZ'), the end (19) of a terminal portion (18) thereof being integral with a fastener (9) secured to the body of the anchor (1). The body comprises a front wing element (2) shaped to go into the ground along an axis (XX') and a rear wing element (3) opposing the pull of the line (8) by abutment in the ground once the anchor is tilted in the ground. In one embodiment, the fastening location (9) is offset to the axis (ZZ') of pull in the direction of the axis (XX') of the anchor body (1). The anchoring device comprises a component (7) for guiding the terminal portion (18) of the pull line (8) between the fastening location (9) and the axis of pull (ZZ'), whereby the fastener is offset. The anchor body (1) comprises a fin-shaped element (6) located on the other side of the plane of the front wing element (2) in relation to the guide component (7).

10 Claims, 6 Drawing Sheets

DEVICE FOR ANCHORING THE FOUNDATION OF A STRUCTURE IN THE GROUND

The present invention relates to a novel device for anchoring the foundation of a structure in the ground.

The technical field of the invention is the field of making ground anchors that are forced into ground of any kind, whether from the surface of the ground or from a wall in an underground gallery or the like, by pile-driving, vibrosinking, pile-jetting, etc. After they have been forced to a certain depth or distance from said surface, such anchors have traction applied to them from said surface by means of a traction device which may be a cable, a chain, a belt, or other deformable rod providing its connection with the anchor is flexible and/or hinged, thereby causing said anchor to tilt into a position where it extends transversely to the traction direction thus enabling it to resist said traction by opposing a maximum surface area of its wing unit thereto, thereby holding the traction device against such traction force up to a certain value.

As in all known devices of the same type, the main applications are anchoring pegs for stays, for cables, for foundation masses, for structure-supporting plates, etc. . . . and more particularly when it is desired to obtain foundation strength even when the ground itself presents poor resistance to traction, thereby creating a foundation mass constituted by the ground itself which is prestressed for that purpose, as taught in European patent EP 317458, published on May 24, 1989 and filed by T.S.I., and which also describes the entire technique for implementing foundation anchoring, the principles of which are therefore known and are not recalled herein.

Numerous other devices are known that enable anchoring to be provided in the ground in the manner described above when describing the technical field of the invention, even when there is no question of making a mass constituted by putting the ground itself under prestress which is the subject matter of the above patent; some such anchor devices have been the subject of patent applications, in particular for devices that are required to tilt or incline the anchor: by way of example, mention can be made of French patent application FR 2 470 823, published on Jun. 12, 1981, in the name of Mr. Pierre CARGIOLLI, which describes a device for loose ground that enables the anchor to be tilted by placing the attachment point of the anchor line in front of the center of its surface area so that, when tension is applied, because of the greater area of the rear portion of the wing unit, the opposing force from the ground applied to the rear portion is greater than that applied to the front portion which therefore rises. Nevertheless, that method is not reliable since the anchor can rise a great deal and can even come out of the ground before the rear portion of the wing unit has been able to come into abutment so that the intended process can take place: this means that the anchoring device is not always at its design depth.

To avoid the above uncertainty, European patent application EP 161190 published on Nov. 13, 1985 in the name of I.F.P. places a flap hinged to the rear of the anchor wing unit for causing blocking to start more quickly prior to tilting. Nevertheless such a device cannot prevent the anchor being raised through a non-negligible distance when tension is applied, particularly in cases where a leader hole is made by means of an auger in order to facilitate pile-driving: a portion of the flap is then in air and its abutment action is reduced and delayed. In addition, given the forces involved, the hinges of the flap can break. Also, while the anchor is being driven down, material can jam between the flap and its abutment, preventing it moving and thus preventing it from performing its function. That reduces to the previous case.

Mention may also be made of British patent GB 2089862 published on Jun. 30, 1982 in the name of E.G. WISE which describes a hinged device for operating, after driving, to tilt the wing unit by rotation about a pin that is kept disengaged by the thrust force from the driving rod prior to changing position by rotation through 180°: that device is complicated and cannot be reliable on site.

Finally, various anchoring systems are known that include ribs and blades on the front portion of the anchor to facilitate driving them in the desired direction, in combination with systems for hinging the point of traction that is offset from the driving axis of the anchor, firstly to keep the cable apart from the driving rod so as to avoid damage to the cable, and secondly to facilitate tilting of the anchor after it has been driven: such a device is described, for example, in European patent EP 313936 published on May 3, 1989 in the name of FORESIGHT INDUSTRIES, INC.; nevertheless, even if control over driving direction in the ground is thus indeed more effective, pivoting of the anchor itself in the ground is not improved, at least not at the desired depth, and it does not take place in reliable manner.

Thus, it has been observed that most present anchors, unless they are associated with complex devices that are mechanical and themselves not very reliable and/or complicated to implement, do in fact often rise without tilting, even so far as to come out of the ground, when a traction force is applied on the anchor line that connects them to the surface: tilting and blocking take place in a manner that is more or less reliable only in ground capable firstly of closing up behind anchors after they have passed through it, and that is also of relatively high density; this restricts situations in which such anchors can be used. In clayey type ground that is too compact, the path opened up by the anchor remains open behind it, and in muddy type sands that are too soft known anchors do not tilt immediately or even do not tilt at all when subjected to traction, thus causing them to rise too far and, naturally, making it impossible to guarantee anchoring depth.

Unfortunately, when it is desired to ensure that anchoring is performed properly, particularly in an application to prestressing the ground as described in above-mentioned patent EP 317458, it is necessary to be certain that tilting takes place at the intended depth in order to guarantee that there exists the necessary volume of ground for constituting the foundation mass, and this applies regardless of the nature of the ground, given that anchoring depth is a function thereof and of the force that it is to withstand.

The problem posed is therefore to be able to make an anchoring device that comprises an anchor and a traction line, which can be implemented essentially to ensure that the anchor tilts as soon as it has reached the desired depth so as to be sure that anchoring takes place at a given depth and that this applies in any type of ground; another object of the invention is to enable said anchor to be driven into the ground while controlling the direction thereof and without any risk of major deflection.

A solution to the problem posed is a device for anchoring the foundation of a structure in the ground, the device comprising an anchor and a traction line along an axis ZZ' that is preferably offset from the axis XX' of the anchor, with the tip at one end of the line being secured to an attachment piece or point which is fixed to the body of the anchor, which body includes a front wing unit shaped to penetrate into the ground along its axis XX', and a rear wing unit for opposing the effect of traction on said line by coming into abutment in the ground after the anchor has penetrated therein by being driven along its axis XX' and then tilted; according to the invention, the anchor device includes a guide and bearing piece for guiding and supporting said end of the line relative to the body of the anchor between said attachment point and the traction axis ZZ' of the line, and said anchor body includes a fin situated on the other side of the plane of the front wing unit relative to said guide piece, enabling desired tilting to be started more reliably.

In an embodiment in which the traction line is deformable, e.g. a cable, with said attachment point for the traction line being offset from the traction axis ZZ' thereof towards the axis XX' of the body of the anchor, said guide piece performs said offsetting and is a portion of the body of the anchor on which said end of the traction cable or line fixed to said attachment point bears.

In another preferred embodiment, in particular when the depth of anchoring is shallow, of the order of less than 1 meter, as in an urban environment and for limited traction forces, said guide piece is constituted by a rigid piece that forms the end of the traction line, which is hinged about said attachment point, and which bears against the body of the anchor via a spring housed therein and which, in the driving position, is compressed between the rigid end of said traction line and said body of the anchor. The traction line may itself be entirely rigid, and thus a single piece, being hinged directly in the body of the anchor about an attachment point secured to the end thereof, e.g. in the form of a stub axle which may either be in line with the traction axis XX' or else be offset relative thereto, the end of the rigid piece then including a bend.

In an embodiment that may include one of the embodiments mentioned above, said anchor also includes another fin for protection purposes disposed in front of said guide piece perpendicularly to the plane of the front wing unit and extending over a height h relative thereto, where h is greater than the distance through which the axis ZZ' of said traction cable is offset relative to the front wing unit of the body of the anchor; preferably, said fins, referred to respectively as a "protection" fin and as a "tilting" fin, are symmetrical about said plane of the front wing unit, are identical, and are both situated in front of said guide piece.

The result is novel devices for anchoring the foundation of a structure in the ground comprising an anchor as defined above that makes it possible to solve the problem posed and that achieve the objects of the invention, which was not possible with devices known in the past.

One of the major novel and original points of the present invention is to define clearly the connection between the end of the anchor line and the anchor itself in a position that is well determined, whereas until now all known anchors have, on the contrary, included connections that are flexible and free, without guidance and without forced support, since attempts have always been made to keep the traction line in alignment with its attachment point on the anchor as soon as tension is applied; that completely prevents creating a deliberate thrust force R extending transversely to the traction direction ZZ', as can be seen in particular in illustrative FIGS. 2 and 8 as described below, thus making it possible in the present invention to obtain instantaneous pre-tilting of the anchor, either as soon as tension is applied to the traction line, or else as soon as the driving rod is removed, and with this being true regardless of the nature of the ground. Numerous tests have demonstrated that anchors of the invention enable said tilting to be obtained at the desired depth, which is not possible with prior art devices; such known devices have not sought to achieve such accuracy concerning depth since the essential purpose of such devices has been to obtain anchorage to withstand a traction force without taking the contribution of the surrounding ground into consideration, whereas in the present case, in order to apply anchoring as defined in European patent EP 317458 mentioned in the introduction, anchoring depth is essential for obtaining sufficient contribution from the ground and thus for withstanding a given force.

Thus, in the examples described below, it will be observed that the end of the anchor line is always deliberately brought into contact with the body of the anchor by means of a guide and bearing piece, either directly or via an intermediate spring, which piece is one of the essential elements of the present invention, whereas in known anchor lines, even those that are hinged or offset relative to the axis of the anchor, the only force transmitted to the body of the anchor is a force in line with the direction in which tension is applied, without provoking a transverse reaction force on the anchor.

In addition, the presence of the fin that may be referred to as a "pre-tilting" fin, as mentioned above, which fin extends perpendicularly to the plane of the main wing unit of the anchor and is situated on the other side thereof relative to the traction line, it becomes possible, not only to achieve better guidance while the anchor is being driven in a given direction, but also to establish a heel that comes into abutment almost immediately as soon as the traction force begins; this generates a genuine and immediate pre-tilting torque on the anchor in combination with the specific disposition of the anchor line in accordance with the invention, as shown in the embodiments of FIG. 2 or of FIG. 8, and with implementation thereof being shown in FIGS. 7 and 11 below.

In known anchors, the moment of tilting as constituted solely by traction being applied to the lever arm formed by the traction line being offset from the axis of the anchor is not sufficient to ensure that said tilting takes place regardless of the ground encountered, as mentioned above, unless it is acceptable for the anchor to rise a certain distance up its hole until friction makes it possible to obtain a tilting torque, merely because the back of the wing unit has had the good luck to come into abutment. That offset is due to the need to leave empty the penetration axis of the anchor in the ground so that the driving rods can pass freely, and various solutions have been proposed such as those mentioned in the introduction for causing tilting to take place, showing clearly that the moment of the above-mentioned forces is indeed considered to be insufficient, but those solutions have not given satisfactory results to date.

In contrast, the results obtained by the elements of the present invention make it possible to achieve pre-tilting automatically, immediately, and irreversibly, thus placing the anchor immediately into the abutment position, said abutment being achieved by means of the additional fin and the rear portion of the wing unit, with it being certain that there will be little or no raising of the anchor.

Also, adding another fin symmetrically disposed to the first and on the other side of the plane of the wing unit serves to protect the anchor line situated behind it, and simultaneously assists in providing guidance while the anchor is being driven into the ground.

The embodiment shown in FIG. 8 below, which has a rigid traction line that may be a single piece between the attachment point and the surface, serves to avoid the need to socket and secure a cable or other deformable line to an anchor piece and/or a linking piece for engaging the anchor, thereby reducing manufacturing costs.

In that embodiment, the existence of a spring enclosed in the body of the anchor and bearing against the end of the anchor line makes it possible, when so decided and then immediately, to obtain pre-tilting of said anchor and to accompany the tilting thereof to an angle of about 30°, thereby making it possible to obtain in irreversible manner the engagement of the rear of the wing unit in the ground at a determined and desired depth, which is particularly necessary when operating at shallow depth in the ground and when it is desired to obtain optimum resistance to traction; the movement is then independent of the shape of the anchor which means that the anchor can be given a shape that is more favorable to penetration into the ground.

Other advantages of the present invention could be mentioned, but those given above suffice to demonstrate the novelty and the advantages thereof. The following description and figures show embodiments of the invention but they are not limiting in any way: other embodiments are possible in the context of the scope and the extent of the invention, in particular by changing the shape of the body of the anchor which may be made either from mechanical pieces that are assembled together and welded or else out of pieces that are cast or forged, or indeed out of other materials, etc. . . . .

FIG. 8 is a longitudinal section view on VIII–VIII' of the plan view of FIG. 10, while FIG. 9 is a section view on IX–IX' of FIG. 8.

The device for anchoring the foundation of a structure in the ground comprises in conventional manner a ground anchor 1 and a traction line 8, where traction is applied on axis ZZ'.

Figure 7:
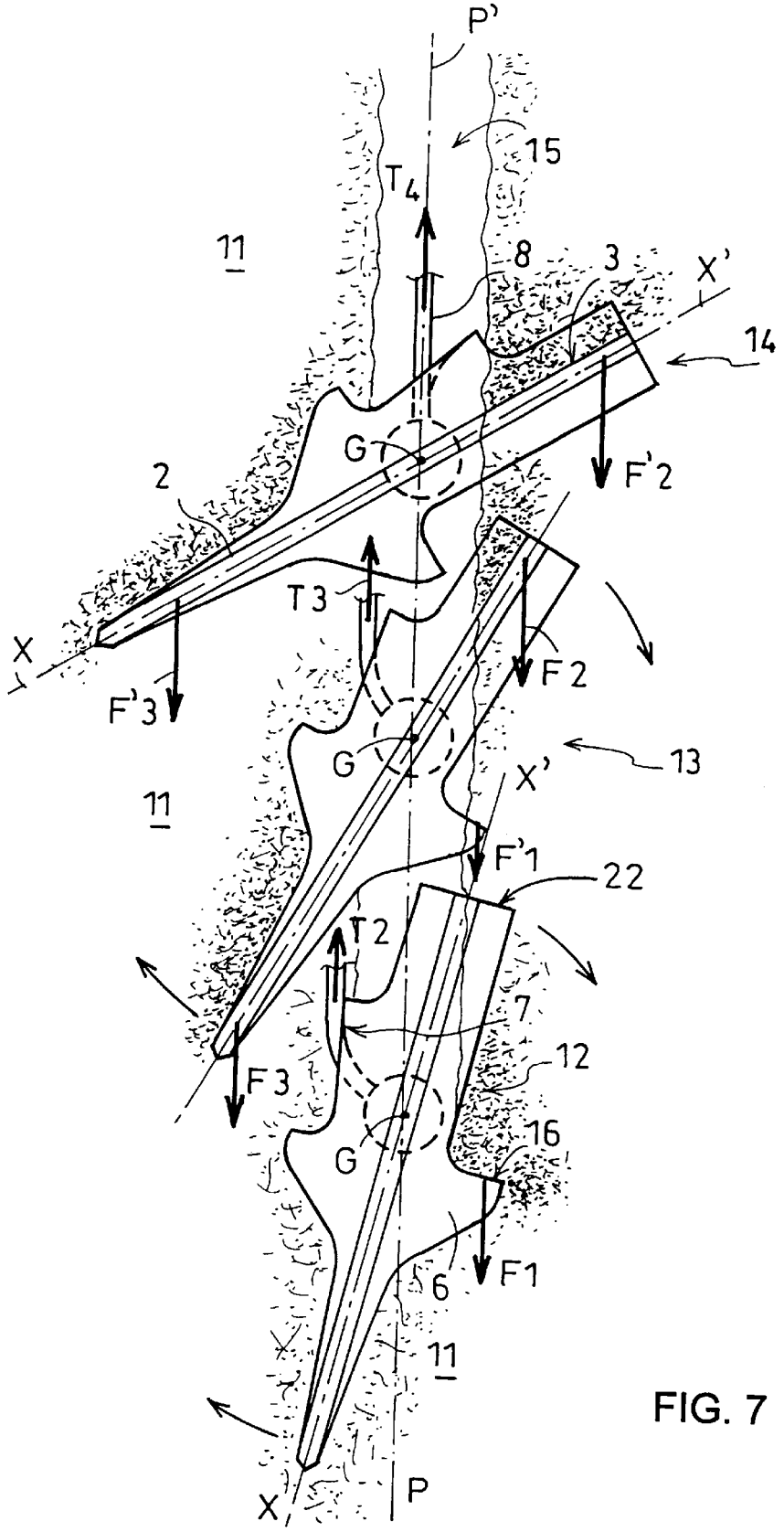
FIG. 7 shows the various stages of tilting when implementing a device as shown in FIGS. 1 to 6.
Figure 9:
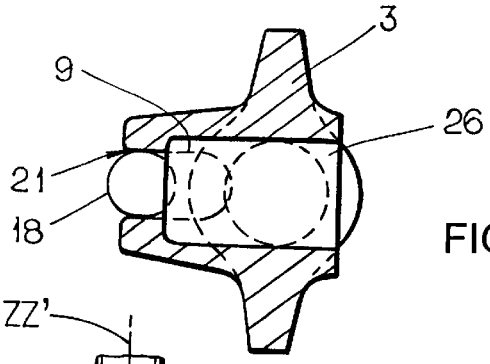
FIGS. 8 to 10 show another embodiment of a device of the invention.
Figure 8:
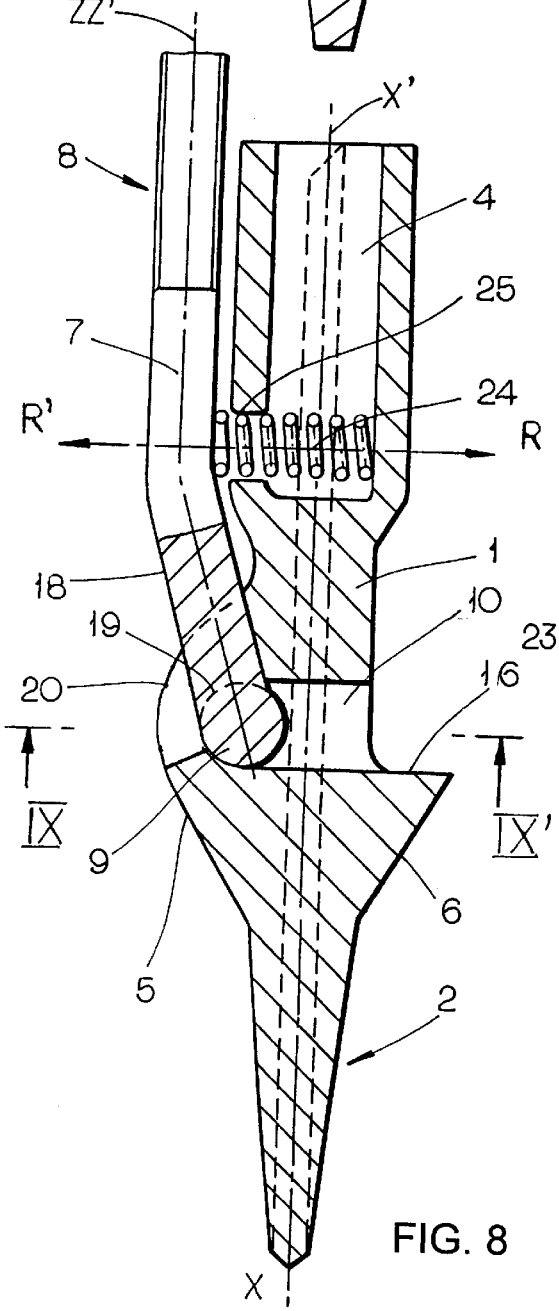
Figure 10:
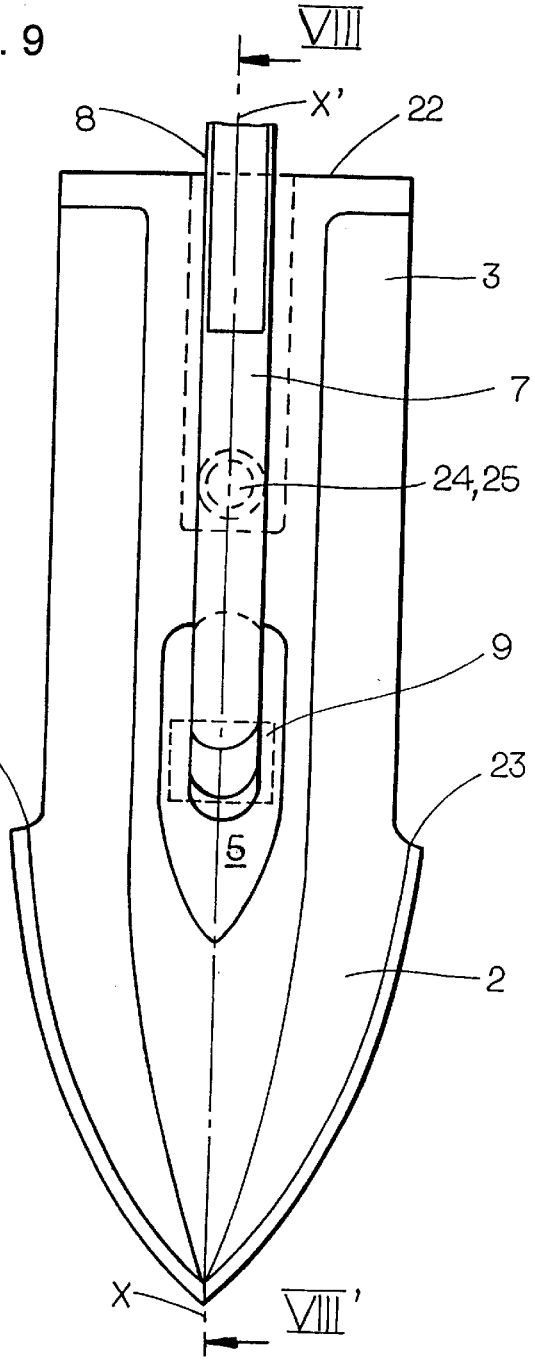

The body of the anchor 1 is constituted by various elements including in particular a front wing unit 2 shaped to penetrate into the ground and which may be constituted by two wings cut to an end point and symmetrically disposed on either side of the plane defined by the axis of the traction line ZZ' and the penetration direction XX' of the anchor: said shaped front wing unit 2 thus enables the anchor to be driven into the ground along said axis XX' by thrust from a driver element 27 (FIG. 11) which is applied from the surface of the ground or from the surface of the wall of the terrain into which said anchor is to be caused to penetrate, and which is received on the axis XX' in the back of the anchor in a housing 4 provided for that purpose. Said anchor body also includes, on either side of said housing 4, a rear wing unit 3 extending the front wing unit 2 and of sufficient area to enable it to opposite the effect of traction from the line 8 when in the anchoring position by coming into abutment in the ground as shown in FIG. 7 after the anchor has penetrated therein and after an initial tilting step, said abutment being represented by the force F'2 in FIG. 7, with the front wing unit 2 then also providing reaction on the other side of the axis ZZ' by coming into abutment in the ground and applying force F'3: it is the combination of these two reaction forces in the ground that make it possible to ensure that the anchor is balanced and that the traction line 8 subjected to the desired traction force T4 after the anchor has been put into place at the desired depth is indeed retained.

The tip of one of the ends 18 of the traction line 8 is secured to an attachment piece or point situated towards the middle of the body of the anchor 1, with said attachment point 9 being necessarily offset from the traction axis ZZ' thereof towards the axis XX' of the body of the anchor 1 in the embodiments of FIGS. 1 to 7, and even being preferably situated on said axis so as to obtain as great a tilting torque as possible, whereas in the embodiments of FIGS. 8 to 12, the offset need not exist or may at least be smaller since the desired and necessary tilting torque is then provided by the power of the compression spring 24.

In FIGS. 1 to 7, said guide and bearing piece 7 is integral with the body of the anchor 1 and has said end 18 of the traction line bearing thereagainst, which line is then necessarily deformable, e.g. being a cable, with a cable being taken as the reference in the remainder of the description of FIGS. 1 to 7, said end 18 being fixed to said attachment point 9: the guide and bearing piece 7 enable the end 18 of the traction line 8 to be guided between said attachment point 9 and the traction axis ZZ' proper, thereby ensuring the said offset and being of a form such that said end 18 of the traction cable 8 forms an angle β of more than 10° and less than 90° relative to the axis XX' of the anchor, and preferably lying in the range 60° to 90°.

Figure 1:
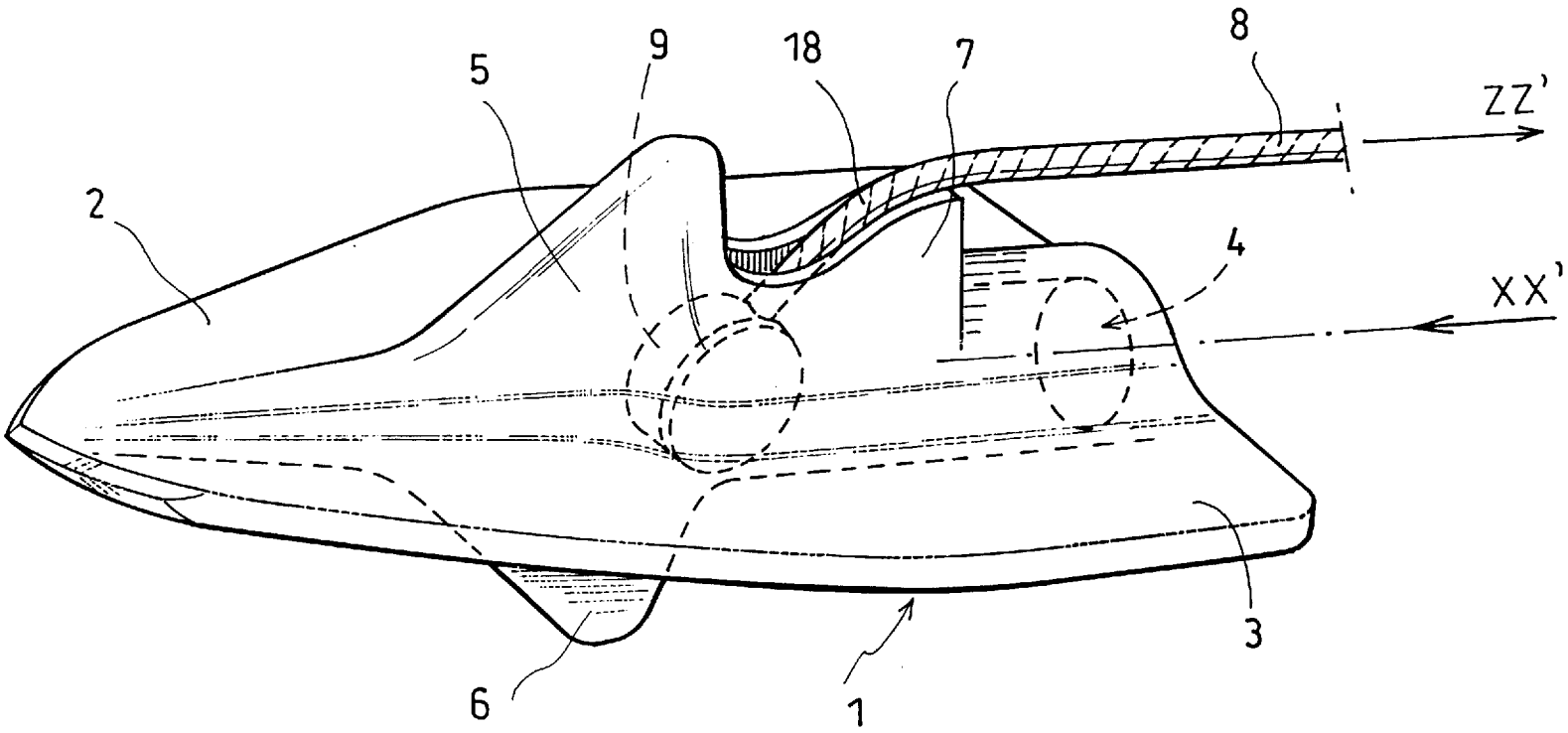
FIG. 1 is an overall perspective view of an embodiment of a ground anchor device of the invention.
Figure 2:
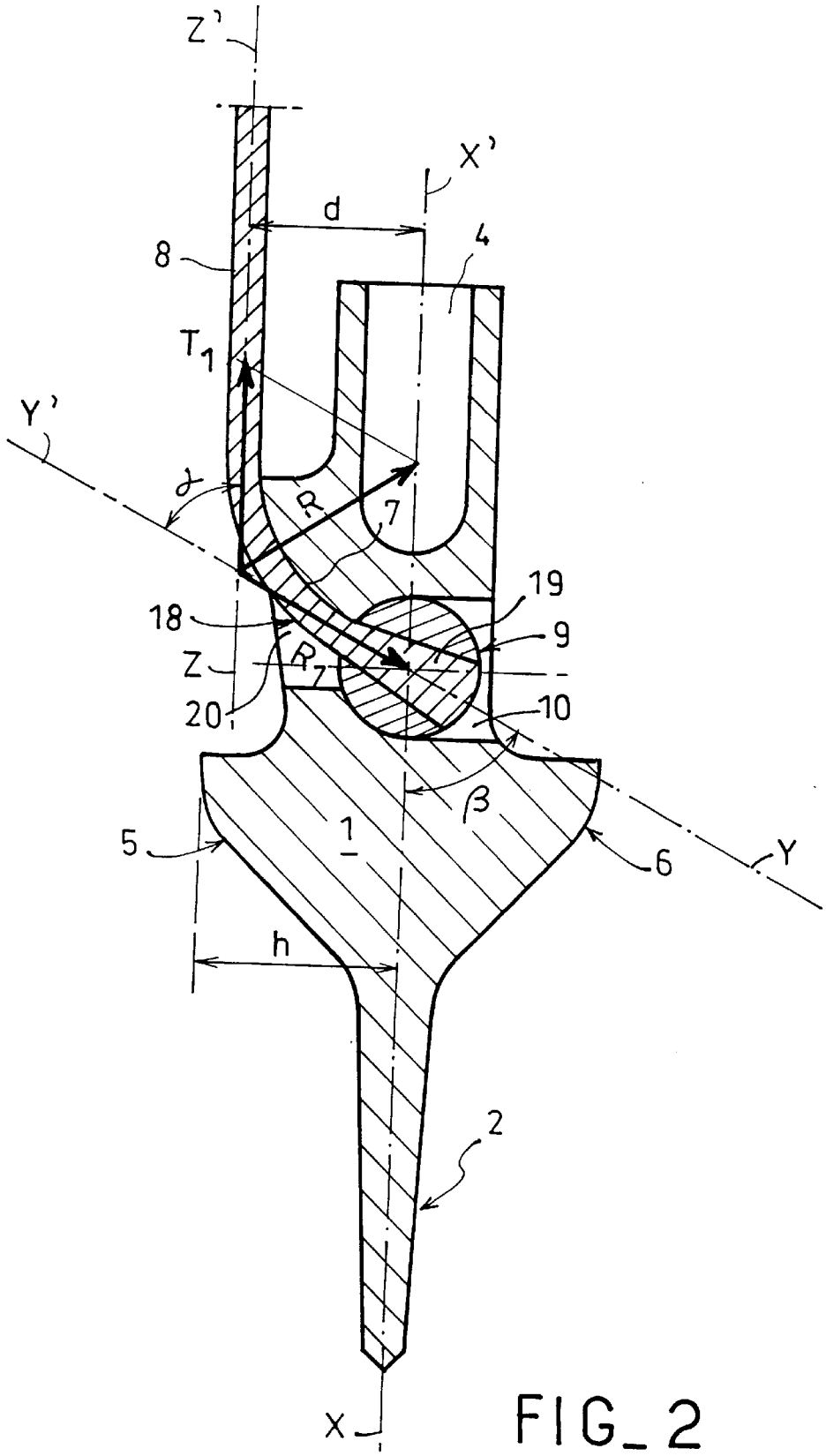
FIG. 2 is a longitudinal section view of a FIG. 1 device.
Figure 3:
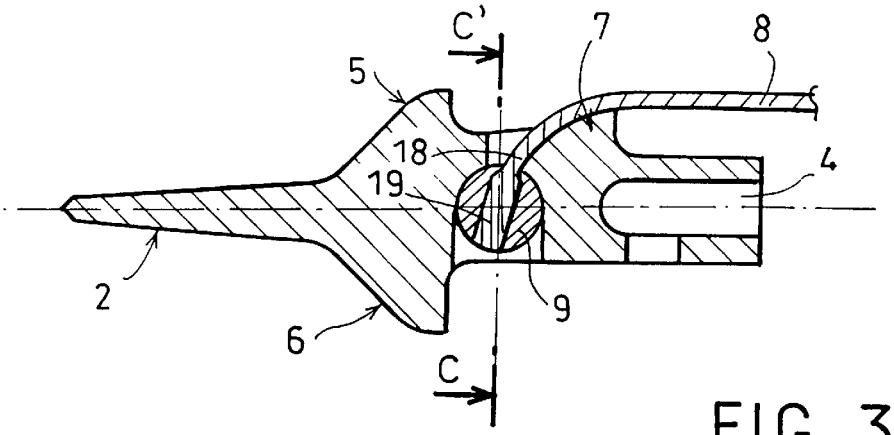
FIG. 3 is a simplified view of the same device as shown in FIG. 2.
Figure 4:
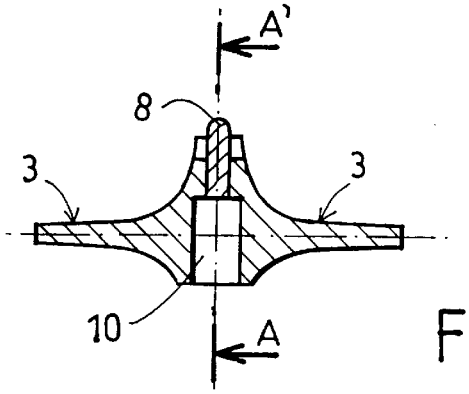
FIG. 4 is a section view on CC' of the FIG. 3 device.

In the embodiment of FIG. 2, or of FIG. 3, or of FIG. 4, said attachment piece or point 9 is constituted by a hinged endpiece whose shape in this case is circularly cylindrical, at least about an axis perpendicular to said axes XX' and ZZ', being fixed to and secured to the tip 19 of the end 18 of the cable 8 on which it is socketed: said endpiece 9 can thus be a piece that is cylindrical or a piece that is spherical: it may also be a fastener in the body of the anchor; the piece constituting the endpiece 9 may have a hollow appendix in which there passes the end 18 of the cable 8: in which case it is the appendix that bears against the guide piece 7 of the body of the anchor. Said endpiece 9 is housed and hinged in a housing 10 of the body of the anchor in which it is capable of pivoting at least about an axis perpendicular to said axes XX' and ZZ' and in communication with a flared orifice 20 through which said end 18 of the cable passes. Said housing is preferably situated in front of the center of the surface of the wing unit 2, 3 of said anchor, taken as a whole.

As can be seen in FIG. 2, when pulling along the axis ZZ' with a force T on the traction and anchor line 8, said force is transmitted at the end 18 of said traction cable 8 to the attachment point or endpiece 9 along an axis YY' which is at an angle a to the axis ZZ', such that when the anchor is in its original, pre-tilting position, e.g. when the anchor is at the bottom of the hole, said angle α is equal to the above-defined angle β.

The combination of the traction force T and the reaction force R1 generated by the endpiece 9 to oppose transmission of said traction to the end 18 of the cable, creates a resultant force R extending transversely to said axes XX' and ZZ', thus creating an immediate tilting torque due to the thrust of the end 18 of the traction line 8 on the bearing piece 7: the inclination of the reaction force R naturally depends on the initial angle β; it is preferable to use an angle in the range 60° to 90°, but even a very small angle of the order of 10° would still provide a reaction force; the maximum value for the angle is 90° since beyond that, a greater angle would create a tilting force that was of no use during anchoring proper of the anchor in its final position in the ground in which it is to remain, and could possibly even be unfavorable for a prestress effect on the ground in which it is desirable to obtain symmetrical distribution of the wing units without any additional tilting force.

Said body of the anchor 1 may also include a protective fin 5 in front of said bearing piece 7 to protect both it and the cable while the anchor is being driven into the ground, the fin extending perpendicularly to the plane of the front wing unit 2 over a height h relative thereto that is greater than the distance d of the offset of the axis ZZ' of said traction cable 8, and the body of the anchor 1 may also include a fin 6 situated on the other side of the plane of the front wing unit 2 relative to said first fin 5.

Said two fins 5 and 6 are preferably symmetrical about the plane of the wing unit 2 and identical so as to balance forces while the anchor is being driven, thus, in combination with the front wing unit 2, ensuring that driving takes place in the intended direction.

As shown in FIG. 7, said fin 5 or top rib has a tapering front end to enable it to penetrate into the ground, to cut the ground and protect the cable 8, whereas the fin 6 or bottom rib, likewise having a tapering front end of the same kind, cuts the ground in the same manner as the top rib, and additionally, by means of its heel, constitutes a tilting abutment, as shown in FIG. 7.

FIG. 3 thus shows the FIG. 2 device in section AA' (see FIG. 4), while FIG. 4 shows the same device in section on CC' of FIG. 3: in this case the housing 10 for the endpiece 9 is cylindrical in shape.

Figure 5:
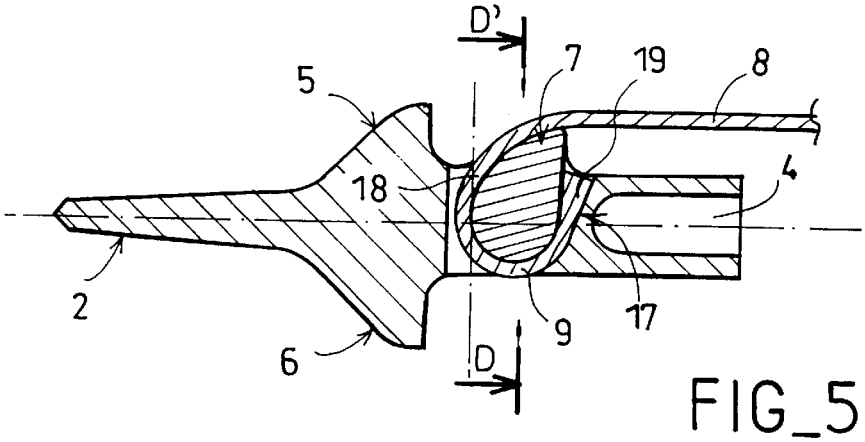
FIG. 5 is a longitudinal section view of another embodiment of a device of the invention.
Figure 6:
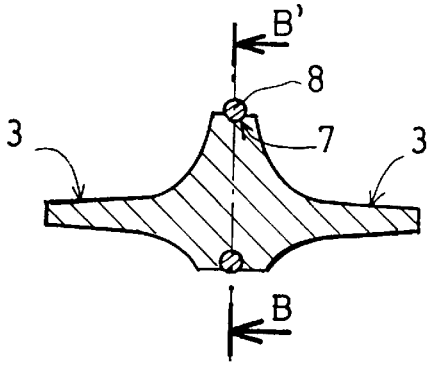
FIG. 6 is a cross-section view on DD'0 of the FIG. 5 device.

As shown in FIGS. 5 and 6, the tip 19 at the end 18 of the cable 8 can be socketed directly in a housing 17 of the body of the anchor 1, and said bearing piece 7 can extend beyond the zone in which it bears against the end of the cable 8 at 90° to the axis XX' into said housing 17 so as to co-operate therewith to constitute said attachment point 9.

FIG. 7 shows three positions of the anchor after it has been put into place, e.g. by pile-driving, so as to leave behind it a borehole 15 of axis PP' in the ground 11 through which it has been driven to the desired depth from which it will then tilt, with the stroke required for tilting being known; depending on the type of ground, said stroke may constitute half the length of the anchor. A small amount of slipping takes place due to the ground compacting around the anchor. Throughout the stage during which the anchor is being driven, the axis PP' of the borehole 5 coincides with the axis XX' of the anchor.

The first step is a pre-tilting step, that is immediate and irreversible and that takes place as soon as tension is applied by the anchor line or cable 8 being subjected to the force T2, with this tilting being due to the resultant of the parallelogram of action and reaction forces shown in FIG. 2. By way of example, the following values may be given to the resultant force R that performs pre-tilting and then tilting depending on the angle of the anchor and for a tensioning force T2 which is, for example, constant and equal to one metric tonne weight: initially, if $\alpha$ or $\beta$ is 90°, R=1.4 tonnes; then as the angle decreases because of tilting, such as in the position 13 of FIG. 7, for example, to a value of 60° (which could under other circumstances likewise be a starting position with $\alpha$ and $\beta$ equal to 60°), R=10,000 Newtons or about 1 tonne; then in a third step of tilting or in an initial position such as the position 14 for example with a being equal to 40°, R =6,840 Newtons; thereafter, beyond that point, when $\alpha$ decreases to 20°, the resultant R also decreases to 3,480 Newtons, but that is no longer of great importance since, under such circumstances, the engagement of the wing units in the ground, in particular the engagement of the rear wing unit, is sufficient to complete rotation from position 14 to the final anchoring position.

The force R is thus naturally greater at the beginning of rotation during the pre-tilting step in which said force, assuming that the angle $\alpha$ is large enough, causes tilting torque to be generated, because of the distance of said resultant R from the point of rotation G, such that the torque is large enough to cause the anchor to tilt in the ground, whatever the nature of the ground.

In position 12 of FIG. 7, immediately after pre-tilting, the force T2 transmitted by the anchor line continues to generate a force and thus a tilting torque on said bearing piece 7 as mentioned above, which force decreases progressively as the anchor tilts, i.e. as the angle $\alpha$ decreases, given that the angle $\beta$ naturally remains constant all the way to the end of tilting. Beyond an appropriate angle $\alpha$, it is the bottom fin 6 that comes into play by forming a bearing and locking point in the ground by means of its heel 16, thus creating a reaction force F1 which opposes upwards movement of the anchor: starting from the resulting position 12, an additional tilting torque is thus established between said ground reaction force F1 and the traction force T2.

In the subsequent tilting stage 13, during which the heel 16 of the bottom fin 6 disengages and thus decreases the reaction force F'1 in the ground, it is the rear wing unit 3 of the anchor that engages fully in the ground whereas initially only its heel 22 was engaged, thereby creating a significant reaction force F2 which, so to speak, takes over from the force F1, F'1 while at the same time the ground reaction force F3 on the front wing unit also begins to become significant, but of a magnitude that is smaller than the rear force F2 since the effective area of the front wing unit in the ground is smaller,-thereby enabling the anchor to continue to tilt.

The end of tilting, as illustrated by way of example in position 14, occurs when the ground reaction forces F'3 and F'2 come into equilibrium, thereby also compensating the tension force T4 applied to the cable 8, relative to the position of the traction point thereof, which is preferably in front of the center of gravity of the surface of the anchor, so as to ensure that said equilibrium is stable: the two torques generated by the two reactions forces in the ground must compensate and thus cancel in order to obtain said equilibrium at the desired final angle for the axis XX' relative to the initial pile-driving axis PP' or the traction axis ZZ' of the cable 8.

As mentioned in the introduction, it is clear that the traction cable 8 used in the present description could be replaced by any other deformable and/or flexible line enabling traction forces to be transmitted, such as a chain, a belt, or any other apparatus such as a deformable rod.

FIGS. 8 to 12 show another embodiment of the invention whose main application is anchoring at shallow depths, down to about 1 meter, and in which said guide and bearing piece 7 is not integral with the body of the anchor as before, but with the traction line 8: it is constituted by a rigid piece forming the end 18 of the traction line 8, and it bears via a spring 24 on the body 1 of the anchor, and it is hinged about the point 9. Under such circumstances, the traction line proper 8 can be a single piece all the way to the surface of the ground, and may include the endpiece 18 and be constituted by a single piece all the way to and including the hinge and the attachment point 9; the traction line up to the surface could also be constituted by a deformable line as in FIGS. 1 to 7, and may be fixed in the vicinity of the anchor 1 to the end of said endpiece 18 remote from its attachment point 9, in which case only the endpiece 18 is rigid.

Figure 11:
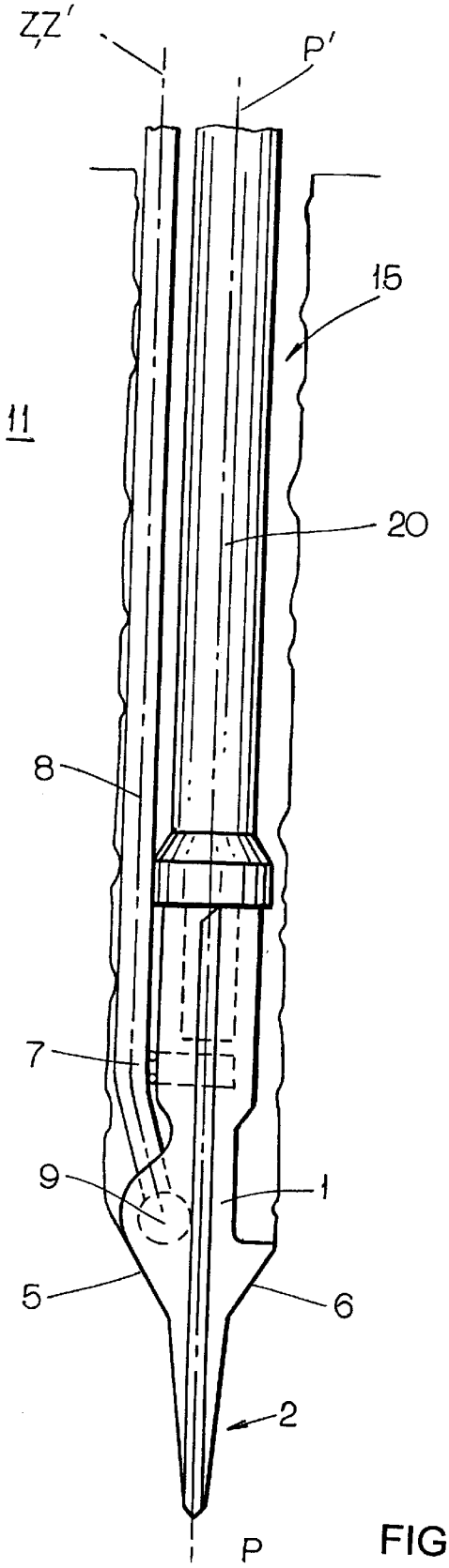
FIGS. 11 and 12 show how the device of FIGS. 8 to 10 operates in use.
Figure 12:
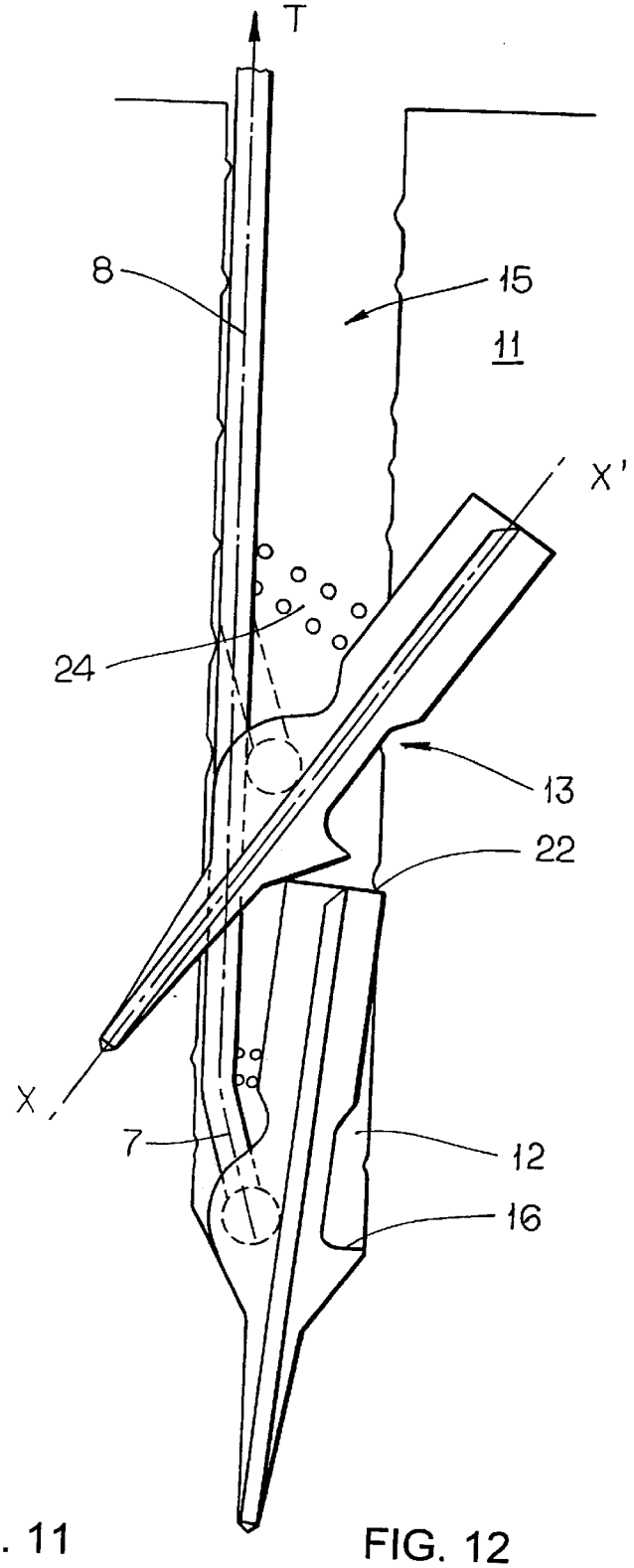

Naturally, in this embodiment, the elements described above are still to be found, such as the main body 1 of the anchor which has a fin constituting a swelling in which the hinge and anchor point 9 is situated, and a fin forming an abutment spur 6 on the other face; the rear portion of the body 1 of the anchor has a bore 4 for guiding the end of a pile-driving rod 21, the rear end 22 of the body 1 serving, amongst other things, as an anvil for said pile-driving rod, as shown in FIG. 11. The wing unit of the anchor is of constant section in its rear portion 3 while its front portion 2 is of tapering section to penetrate into the ground 11 and has two lateral heels 23 that facilitate gripping in the ground when traction T is applied to the anchor line 8; the embodiment shown in FIGS. 11 and 12 corresponds to the same stages as those described with reference to FIG. 7, and reference can be made thereto, in particular for the pre-tilting positions 12 and 13 in FIG. 7.

The shape of such an anchor is designed to provide as small a resistance to penetration into the ground as possible, even though it is possible to form lead boreholes prior to driving the anchor into the ground, said shapes being tapering arrowheads, and all of the elements of the wing unit join the body proper of the anchor via large radiuses of curvature.

A housing 10 is formed in the main body 1 of the anchor in which the end attachment point 9 of the anchor line 8 is engaged, as by a tenon hinge or on an axis or cylindrical stub axle that forms a portion of said anchor line; said housing 10 opens via an opening 20 to the face of the anchor that may be referred to as its "dorsal" face to allow the rigid piece 7 at the end 18 of the anchor line 8 to pass and rotate relative to the anchor, e.g. through about 90°, between a driving position and a final anchoring position; the anchor line may be threaded therethrough during assembly via the "ventral" face of the anchor into which said housing 10 opens out.

The hinge 9 is situated slightly in front of the center of the surface area of the anchor 1, and another bore 25 situated behind said hinge 9 contains the spring 24 and can communicate with the bore 4 for the driving rod: the spring 24 gives a pre-tilting impulse for engaging the anchor while it is being put into place when the driving rod 27 is removed. Insofar as the entire traction line 8 is rigid all the way to the surface, this rectifying compression can be maintained from the surface throughout driving, otherwise, if the traction line is deformable, at least in part, a stud or any other holding means may be secured to the driving rod 27 to keep the end 18 thereagainst until the driving rod is withdrawn. The spring 24 is of the coil spring type and it operates in compression: it is well protected from the surrounding medium 11 during driving since it can be entirely housed within the bore 25, which bore is closed at that time by the rigid piece 7 preventing any gravel or other ground particles penetrating, which particles could impede expansion of the spring.

By having the end portion 18 of the anchor line curved into an angled shape, it is possible to accommodate the offset between the traction line ZZ' and the hinge axis 9: this offset can be of use for engaging the stub axle 9 in the body of the anchor without it being necessary to enlarge it excessively, but it need not be provided given the existence of the spring 24 which itself provides the tilting torque by means of its reaction force R. It would even be possible to envisage a rigid traction line 8 located on and hinged on the driving axis XX': under such circumstances, the traction line 8 may itself be used for driving, or else the driving rod 27 is hollow and surrounds the traction line 8; the spring 24 would then be situated in a bore that is offset relative to the axis XX'.

During testing performed on an anchor that was 200 millimeters long and 70 millimeters wide, having a total wing unit area of 105 $cm^2$, made of all-welded steel, weighing about 1.2 kg, with a rigid anchor line having a strength of about 14,000 Newtons, and with the anchor having a strength of about 30,000 Newtons, immediate tilting was obtained for a spring force of at least 150 Newtons, and it was obtained at the desired depth and for a nominal anchoring capacity in hard ground of about 7,000 Newtons.

We claim:

1. Device for anchoring the foundation of a structure in the ground, the device comprising a ground anchor, including an anchor body, and a traction line having an axis ZZ' for traction along the axis ZZ', said traction line having a tip at an end of the line that is secured to an attachment point that is fixed on the anchor body, said anchor body including a front wing unit having an axis of XX' and shaped to penetrate into the ground along the axis XX', and a rear wing unit for opposing the effect of traction on said line by coming into abutment with the ground after the ground anchor has penetrated therein and has tilted, wherein the device includes guide and bearing means, including a guide piece disposed between said attachment point and the axis ZZ', for guiding and supporting said end of said traction line and for transmitting to the anchor body a force transverse to the axis ZZ', thereby to create tilting torque when said end is put under tension by the traction line along said axis ZZ', said front wing unit defining a plane having first and second sides, said guide piece being disposed on the first side of the plane, said anchor body including a fin situated on the second side of the plane and including a heel which bears against and jams in the ground once the traction line is put under tension along the axis ZZ' so as to tend to cause the anchor to be raised.

2. A device according to claim 1, wherein said guide piece is constituted by a rigid piece forming the end of the traction line, hinged about the attachment point, and bearing against the anchor body via a spring.

3. A device according to claim 2, wherein said rigid piece is angled and has an end that terminates in stub axles constituting said attachment point of the traction line.

4. An anchor device according to claim 1, wherein said attachment point of the traction line is offset from the axis ZZ' towards the axis XX', said guide piece ensuring said offset and being a portion of the anchor body on which said end of said attachment point of the traction line bears, which traction line is deformable.

5. A device according to claim 1, wherein said attachment point is constituted by an endpiece in the form of a circular cylinder at least about an axis perpendicular to said axes XX' and ZZ' which endpiece is stationary and secured to the tip of said end of the traction line and is hinged in a housing formed in the anchor body in which housing it can rotate.

6. A device according to claim 4, wherein the tip of said end of the line is directly socketed in a housing of the body of the anchor, and said bearing and guide piece extends beyond a bearing zone for the end of the line at 90° to the XX' axis as far as said housing to cooperate therewith to constitute said attachment point.

7. An anchor device according to claim 3, wherein said attachment point is situated on the axis XX'.

8. A device according to claim 3, wherein the angle between the end of the traction line and the axis XX' lies in the range 10° to 90°.

9. A device according to claim 1, wherein said anchor includes a protective fin in front of said guide piece and extending perpendicularly to the plane of the front wing unit over a height h therefrom that is greater than an offset distance of the axis ZZ' of said traction line.

10. A device according to claim 9, wherein the fin situated on the second side and the protective fin are symmetrical about said plane defined by the front wing unit, are identical, and are both situated in front of said guide piece.

* * * * *